US006102263A

United States Patent [19]

Rosato et al.

[11] Patent Number: 6,102,263

[45] Date of Patent: Aug. 15, 2000

[54] SMART CADDY

[76] Inventors: Daniel P Rosato, 828 Jerusalem Ave., Merrick, N.Y. 11566; James F Luginsland, 49 Westwood Ave., Deer Park, N.Y. 11729

[21] Appl. No.: 09/206,611

[22] Filed: Dec. 7, 1998

[51] Int. Cl.[7] ..... B65D 83/04

[52] U.S. Cl. ..... 224/196; 224/666; 224/679; 224/918; 224/919; 221/185; 221/309; 221/310

[58] Field of Search ..... 224/919, 918, 224/245, 666, 678, 679, 196; 221/185, 309, 310, 307; 206/315.9

[56] References Cited

U.S. PATENT DOCUMENTS

| | | | |
|---|---|---|---|
| 1,810,491 | 6/1931 | McClure | 224/919 |
| 2,768,775 | 10/1956 | Houser | 224/919 |
| 3,298,579 | 1/1967 | Smith | 224/918 |

*Primary Examiner*—Linda J. Sholl

*Attorney, Agent, or Firm*—Michael I. Kroll

[57] ABSTRACT

The present invention 10 discloses a device for holding golf balls 30 having a vertically oriented magazine-like container 12 having a spring-loaded clip 14 on its side for being attached to the belt 16 of the user 18 or other golf paraphernalia such as a bag. The container 12 is equipped with an inner spring 40 on its inside upper surface for putting downward pressure on the balls 30. The balls 30 are also held inside the container 12 by vertical members 34 located in a spaced apart relationship on the interior of the container 36 and held in place by springs 44. The vertical members 34 are further equipped with a roller bearing 38 on their lower end which grips the balls 30 and prevents the balls from being discharged from the container 12 until the user 18 so desires. The container 12 is also equipped on its outer lateral surface with an aperture or notch 32 which allows the user 18 to insert his finger and remove the balls 30 from the container 12. The container 12 also has a magnetic external top surface 28 for holding a metallic ball marker 26 and external tee holding members 22.

10 Claims, 5 Drawing Sheets

SMART CADDY

BACKGROUND OF THE INVENTION

1. Field of the Invention

The present invention relates generally to golf and, more specifically, to a portable golf ball carrying container having a clip located on one side for the purposes of carrying said container from the person or a golf bag.

Also located on the exterior surface toward the upper half of the container are a plurality of u-shaped longitudinal protrusion extending from the container and each having an aperture passing therethrough for the purposes of inserting and carrying a number of additional tees and a magnetic external top surface for carrying a metallic ball marker.

Also, located on the lower half of the container is a vertical aperture passing to the base of the container having an open end therein. The vertical aperture allows easy access for the insertion therein or removal therefrom of the golf ball or golf balls by being wide enough to insert the tip of the thumb.

Located within said container is a spring, acting as one part of a noise abatement apparatus, located on the inside top surface for the purposes of keeping the golf balls therein under a predetermined amount of pressure and additionally within said container is a second part of a noise abatement apparatus, as well as allowing different sized golf balls to be retained within said container, comprising one or more vertical members being connected to and spaced away from the interior wall by a plurality of springs thereby applying a longitudinal pressure to the one or more golf balls contained within said container.

2. Description of the Prior Art

There are other devices designed to carry and supply spare golf balls. Typical of these is U.S. Pat. No. 4,798,319 issued to James, Jr. on Jan. 17, 1989.

Another patent was issued to Oh on Feb. 22, 1994 as U.S. Pat. No. 5,288,002. Yet another U.S. Pat. No. 5,494,202 was issued to Wyatt on Feb. 27, 1996 and still yet another was issued on Sep. 10, 1996 to Coles as U.S. Pat. No. 5,554,077.

A portable ball caddy is set forth wherein a vertically oriented magazine tube is securable about the body of a user by a plurality of belts. The magazine is secured to the belts and is opaque except for an indicator slot formed therein to exhibit the presence of balls therein. A spring loaded platform biases the balls towards an overlaying exit formed of a flexible membrane of a memory retentent material. An opening is formed in the membrane of a diameter less than the diameter of the magazine tube and of the balls positionable therein. Formed on at least one diameter of said opening is an access relief enabling a user to position a finger therethrough for grasping of a ball adjacent the membrane thereunder.

A holder for carrying golf balls is disclosed which has a frame member and two pair of loop members. The loop members have a diameter greater than half the diameter of a ball but less than the diameter and are retained on the frame in a spaced relationship. A belt clip fixed to the frame attaches the unit to the users clothing.

A golf accessory holder for holding one or more golf balls, golf tees and other golf accessories. The golf accessory holder includes a housing (12) having an inner chamber (21) in which golf balls are received. A pusher plate (36) mounted to a compression spring (32) engages and urges the golf balls into tight frictional engagement with a first end (13) of the housing (12) to secure the golf balls within the golf accessory holder.

A ball dispenser is formed by a cylindrical housing or tube with a piston slidable therein and biased to a dispensing end of the tube. A cap is connected by a bridging member to the tube and projects over the axial center line of the cylinder and is formed with a concave spherical shape to receive the end of a ball contained within the dispenser. The dispenser is symmetrical on opposite sides of a central plane and an assess opening of mouth is provided adjacent to the cap through the side of the tube opposite the bridging section. The mouth is symmetrical on opposite sides of the plane and has its maximum opening at the central plane. The periphery of the mouth is defined by substantially V-shaped sides on each side of the plane with the bottom of the V-shapes adjacent to the bridging section. The front edge or lip of the cap i.e. at the plane overlaying the mouth is closer to the cylindrical axis than the spherical radius of the ball to be dispensed so that the ball may be retained in the cap by the spring pressure on the piston and yet be easily withdrawn therefrom through the mouth or balls may be slid through the mouth with a rotating around the front lip of the cap.

While these golf ball carrying containers may be suitable for the purposes for which they were designed, they would not be as suitable for the purposes of the present invention, as hereinafter described.

SUMMARY OF THE PRESENT INVENTION

The present invention discloses a vertically oriented magazine-like container having a spring-loaded clip on its side for being attached to the belt of the user or other golf paraphernalia such as a bag. The container is equipped with an inner spring on its inside upper surface for putting downward pressure on the balls. The balls are also held inside the container by vertical members located in a spaced apart relationship on the interior of the container and held in place by springs. The vertical members are further equipped with a roller bearing on their lower end which grips the balls and prevents the balls from being discharged from the container until the user so desires. The container is also equipped on its outer lateral surface with an aperture or notch which allows the user to insert his finger and remove the balls from the container. The container also has a magnetic external top surface for holding a metallic ball marker and external tee holding members.

A primary object of the present invention is to provide a compact, efficient and economical carrying case for additional golf balls, tees and ball marker and wherein said carrying case has spring compression attachment means and noise abatement means for the contents of said container.

Another object of the present invention is to provide a container for carrying golf balls, ball marker and tees having a spring clip which provides means for attaching said carrying case to the person, such as hung from a belt, or to golf equipment, such as from a golf bag.

Yet another object of the present invention is to provide a container having a magnetic exterior top surface providing means for attaching a metallic ball marker.

Still yet another object of the present invention is to provide a container for carrying golf balls, ball marker and tees having a simple mechanism providing easy access to the storage compartment of said container.

Yet another object of the present invention is to provide a container for carrying golf balls, ball marker and tees wherein different sized golf balls can be stored.

Still yet another object of the present invention is to provide a container for carrying golf balls, ball marker and tees which will prevent the contents from falling out or rattling around during vigorous physical motion.

Additional objects of the present invention will appear as the description proceeds.

The present invention overcomes the shortcomings of the prior art by providing a portable golf ball carrying container which can be attached to the person by means of a spring compression clip and where a plurality of golf tees can be stored in individual holders and wherein the contents of said container are kept under constant longitudinal pressure which prevents the golf balls from falling out, as well as, preventing them from rattling around especially during vigorous physical movement and wherein the golf balls are easily accessible through a vertical aperture located on one side of the container. In addition, the exterior upper surface of said container having been magnetized will hold a number of metallic ball markers.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
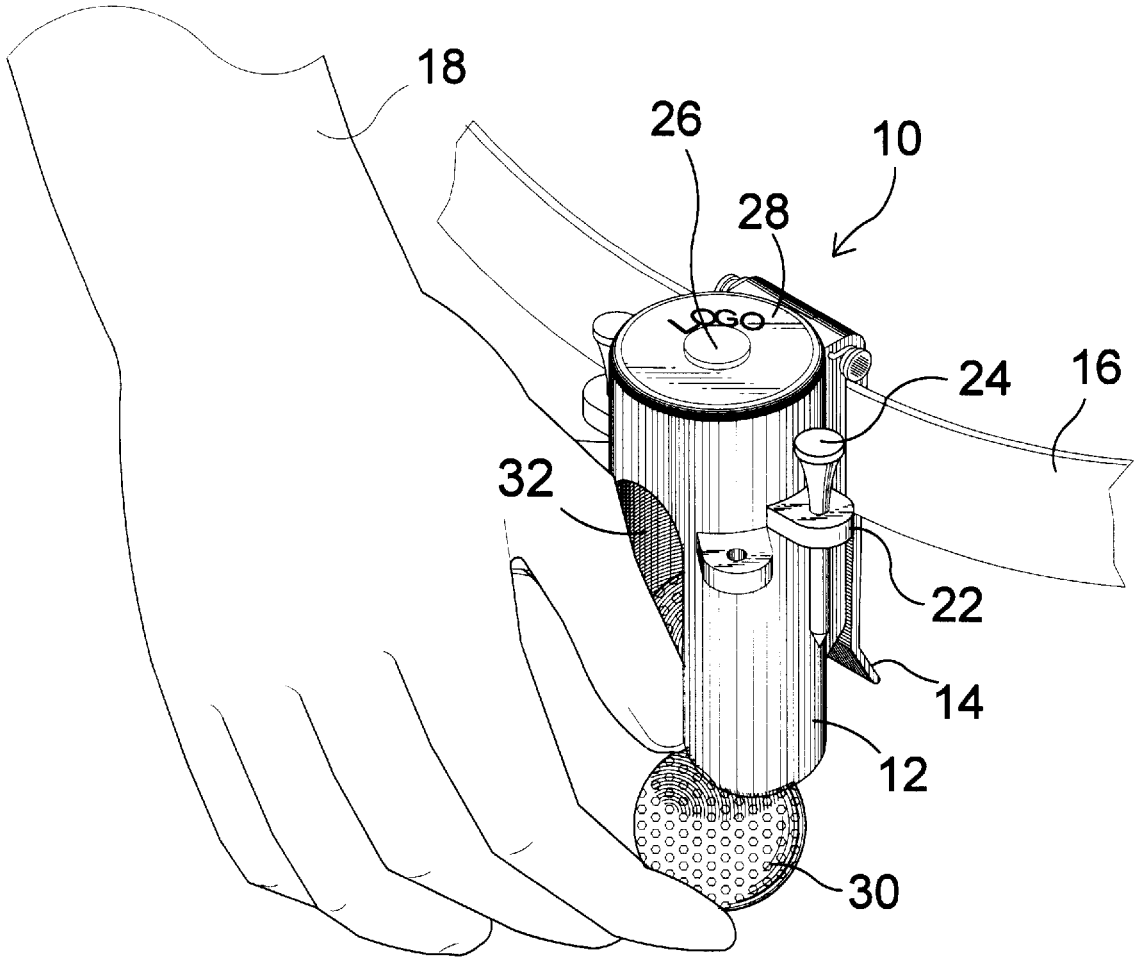
FIG. 1 is a perspective view of the present invention in use wherein the portable golf ball carrying container is being retained by a spring compression clip member to the belt of an individual. Also shown are additional tees and a metallic ball marker magnetically attached to the exterior upper surface of the container. Also shown, is a golf ball being removed through use of the vertical aperture.

With regard to the reference numerals used, the following numbering is used throughout the various figures.

10 present invention
12 container
14 clip
16 belt
18 user
20 clip spring
22 tee holder
24 tee
26 ball marker
28 top of container
30 ball
32 outer aperture
34 interior vertical member
36 inside surface of container
38 roller
40 spring
42 upper inner surface
44 vertical member springs
46 clip hinge

DESCRIPTION OF THE PREFERRED EMBODIMENT(S)

Turning now descriptively to the drawings, in which similar reference characters denote similar elements throughout the several views, FIGS. 1 through 5 illustrate the present invention being a device for holding golf balls and tees.

Turning to FIG. 1, therein is shown a perspective view of the present invention 10 in use wherein a portable vertically oriented magazine tube or golf ball carrying container 12 is being retained by a spring compression belt clip member 14 to the belt 16 of an individual 18. The coiled clip spring 20 provides tensioning to hold the belt between the clip 14 and the body of the container 12. Also shown are multiple members 22 for holding additional tees 24. A metallic ball marker 26 can be attached to the magnetic exterior upper surface 28 of the container 12. Also shown, is a golf ball 30 being removed by the fingers of the user by using the vertical aperture 32 which is located on the exterior outer lateral side of the casing 12.

Figure 2:
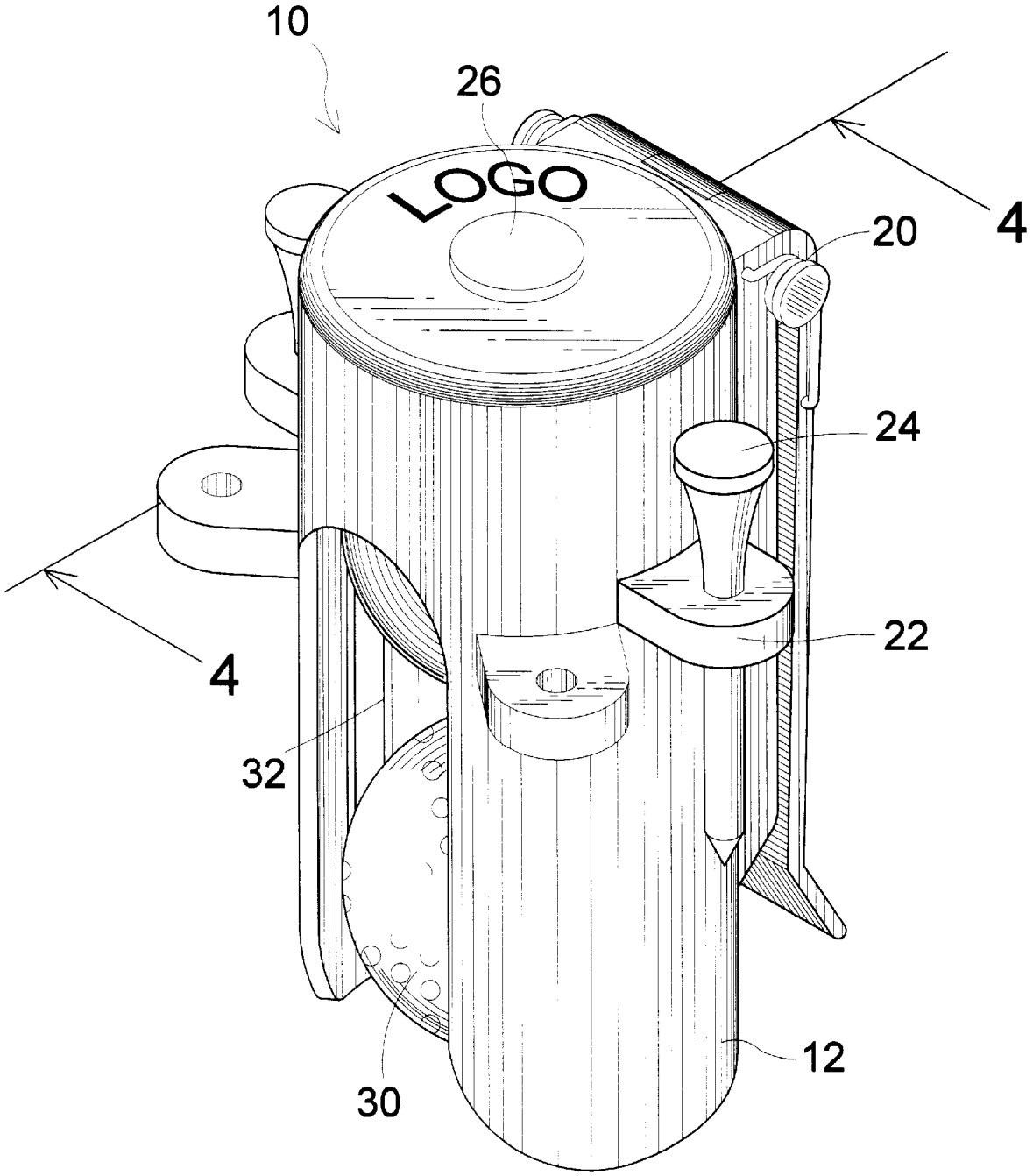
FIG. 2 is an enlarged perspective view of the present invention. Shown is the body of the container having external storage means for additional tees and a magnetically attached metallic ball marker, and spring clip compression means for attachment to an individual, such as a belt or to golf equipment, such as a golf bag. Also shown, is the vertical aperture to aid in the removal therefrom or insertion therein of a golf ball or golf balls.

Turning to FIG. 2, therein is shown an enlarged perspective view of the present invention 10. Shown therein is the body of the container 12 having multiple U-shaped external storage means 22 located in the generally horizontal plane for additional tees 24 to be placed in apertures having a generally vertical axis and a magnetically attached metallic ball marker 26 and spring clip compression means 20 for attaching the container to an individual, such as a belt or golf equipment such as a golf bag. Also shown is the vertical outer aperture 32 to aid in the removal therefrom or insertion therein of a golf ball 30.

Figure 3:
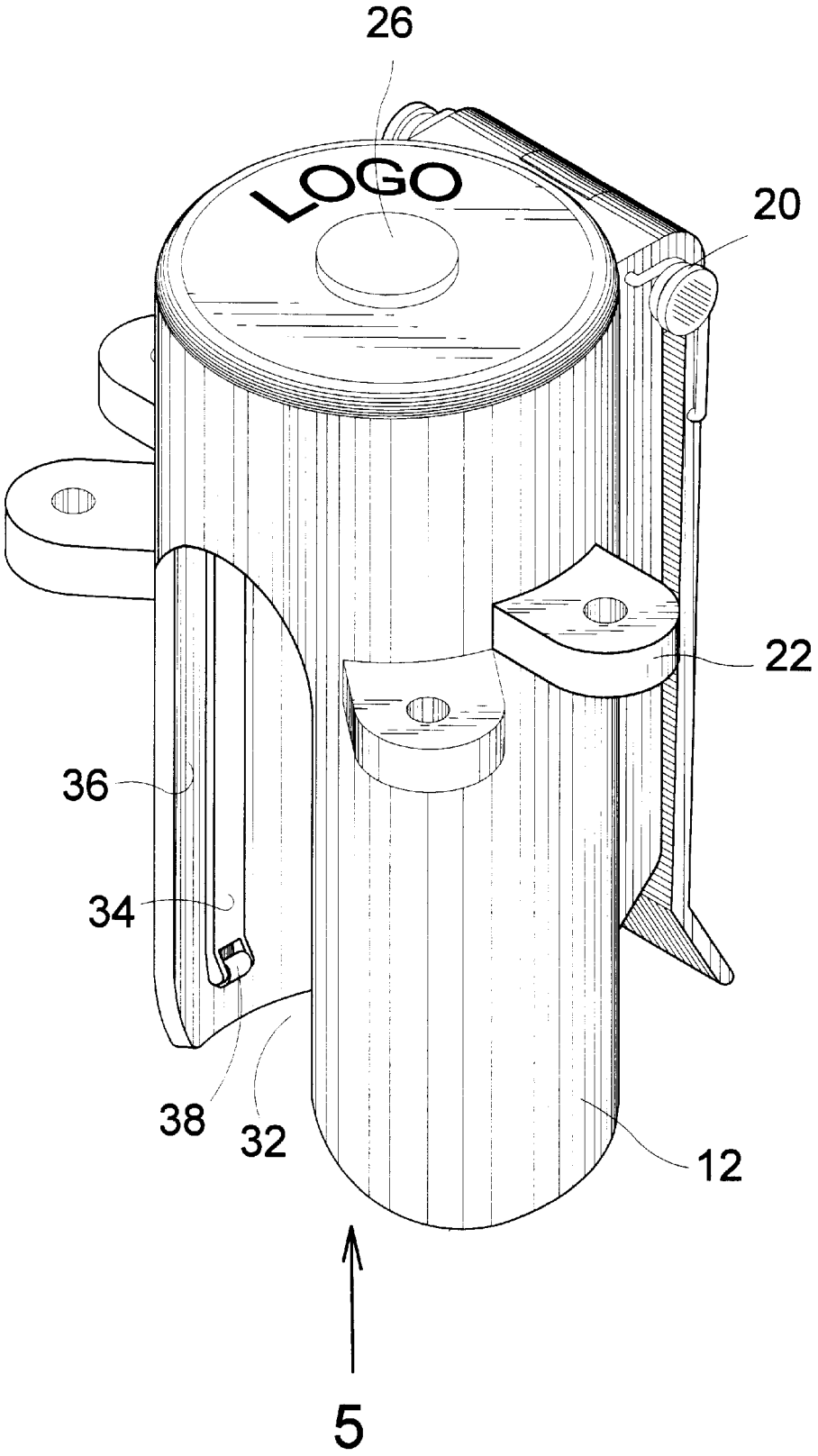
FIG. 3 is a perspective view of the present invention with the golf equipment removed. Shown are the spring compression clip providing means of attachment, external longitudinal protrusions having apertures passing therethrough providing means for carrying additional tees, a metallic top exterior surface providing magnetic means for attachment of a metallic ball marker, a vertical aperture within the wall of the container providing means for easily inserting therein or removal therefrom of a golf ball or golf balls. Also shown is one of the interior vertical members being spaced away from the interior wall by one or more springs and having a roller located at one distal end to keep the golf balls within the container.

Turning to FIG. 3, therein is shown an enlarged perspective view of the present invention 10. Shown therein is the body of the container 12 having external storage means 22 for additional tees (not shown) and a magnetically attached metallic ball marker 26 and spring clip compression means 20 for attaching the container to an individual, such as a belt or golf equipment such as a golf bag. Also shown is the vertical outer aperture 32 to aid in the removal therefrom or insertion therein of a golf ball. Also shown are the vertical spring compression clip members 34 providing means of ball engagement, which help hold the golf balls (not shown) tightly inside the container 12 until the user removes the ball. Also shown is one of the interior vertical members 34 being spaced apart from the interior wall 36 of the container 12 by one or more springs (not shown) and having a roller bearing 38 located at one lower distal end to help keep the golf balls in the container 12 so that the balls do not rattle about as the user moves.

Figure 4:
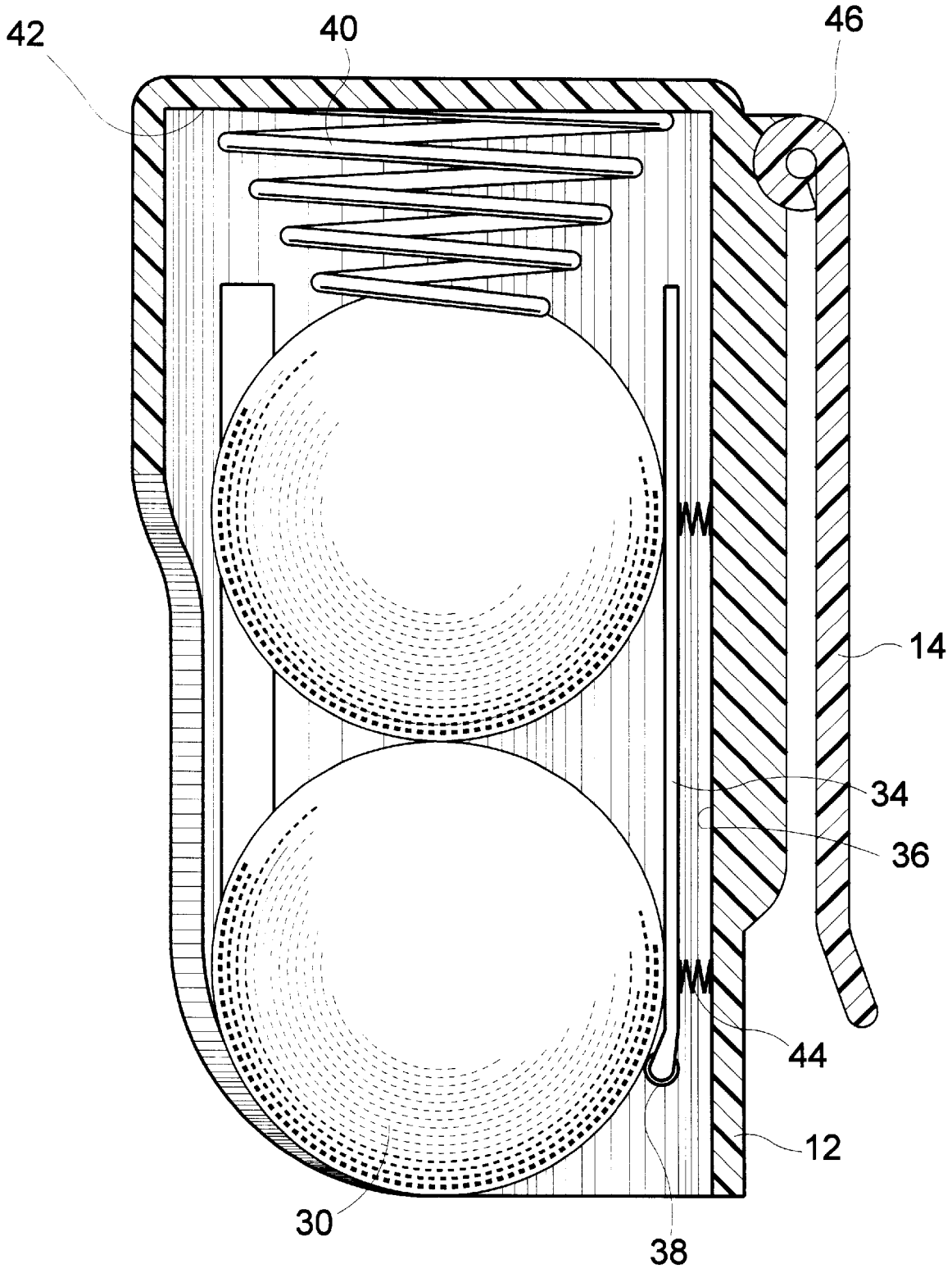
FIG. 4 is a sectional view, taken from FIG. 2 as indicated, showing the interior of the container wherein is housed a spring attached to the upper surface to maintain a constant downward pressure upon the golf balls. Also shown are the vertical members having a roller bearing located on one distal end and wherein said vertical member is spaced apart from the interior wall by a plurality of springs.

Turning to FIG. 4, therein is shown a sectional view, taken from FIG. 2 as indicated, showing the interior of the container 12 wherein is housed the first coiled spring means 40, said spring being attached to the upper inner surface 42 of the container 12 in order to maintain a constant downward pressure on the golf balls 30. Also shown are the multiple vertical members 34 having a roller bearing 38 located on one distal end wherein said vertical members are held in a spaced apart relationship from the interior wall 36 by a plurality of second coiled spring means 44 which springs are located in the generally horizontal plane. The members 34 are spaced apart from each other by a distance slightly less than the diameter of the ball 30 so as to engage the ball securely. Also shown therein is the clip 14 along with the hinge 46 which allows the clip to move. It can be seen that the roller bearings 38 prevent the balls 30 from being discharged from the container 12 due to the downward tension of the upper spring 40.

Figure 5:
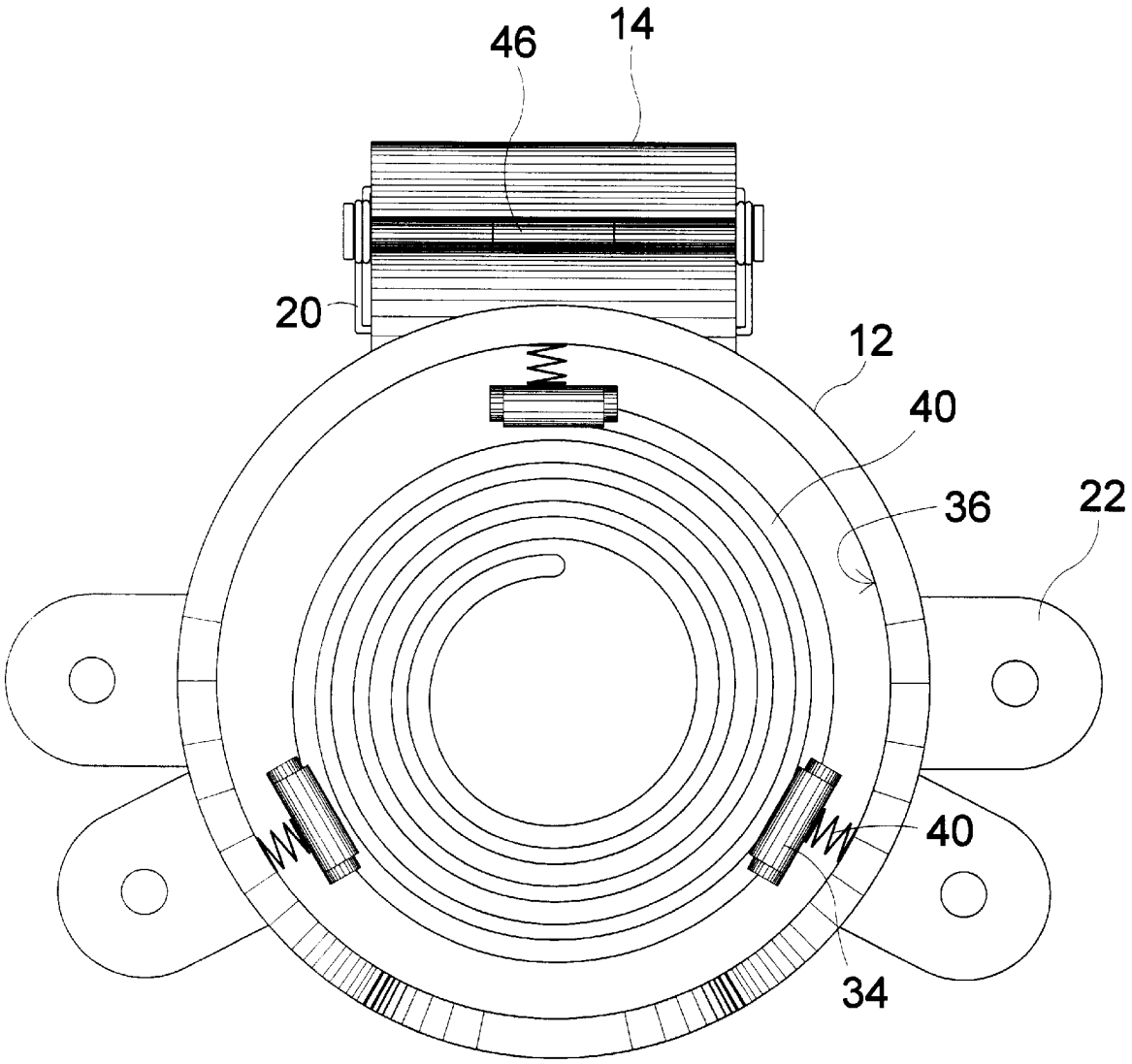
FIG. 5 is bottom view looking into the container, taken from FIG. 3 as indicated, showing the spring located on the top interior surface providing vertical pressure and a number of installed vertical members, spaced apart from the interior wall by a plurality of springs, which will provide longitudinal pressure and the roller bearing which will prevent the accidental discharge of the golf balls from the container during vigorous physical motion.

Turning to FIG. 5, therein is shown a bottom view looking into the container 12, taken from FIG. 3 as indicated. Shown is a coiled spring 40 which is located on the top inner surface providing downward vertical pressure to the balls. A number of installed vertical members 34 are spaced apart from the interior wall 36 by a plurality of coiled springs 40 applying pressure away from the wall toward the ball. Also shown therein is the clip 14, clip springs 20 along with the clip hinge 46. Also shown are the tee holders 22.

What is claimed is new and desired to be protected by Letters Patent is set forth in the claims:

1. A device for holding golf balls, comprising:

a) a vertically oriented cylindrical container having within a plurality of golf balls vertically arranged;

b) said container being open on its lower end;

c) said container having a clip mounted on the outside of said container for attachment to a belt, said clip comprising a vertically extending clip member attached at a top thereof by a spring loaded hinge;

d) said container having a first and a second interior spring-loaded means for applying pressure to said balls whereby the balls are securely held; and, e) said container having a lateral opening adapted to permit the use of a finger to reach into the interior of said container above a lowermost golf ball to permit removal of the golf ball;

f) said first spring-loaded means comprising a coiled spring located on the interior surface of the top of said container to exert downward pressure on said balls;

g) said second spring-loaded means comprising at least three vertically extended members spaced in an annular arrangement along the interior of said container and spaced away from the interior wall of said container with multiple spaced coiled springs for each said extended members, said springs mounted on said interior wall acting perpendicular to said interior wall urging each of said extended members inwardly against said balls within said container; and h) a roller bearing mounted on a lower end of each of said vertically extending members and protecting radially inwardly to prevent the lowermost ball from falling out of said container.

2. The apparatus of claim 1, wherein said multiple vertical members are three in number.

3. The apparatus of claim 1, wherein said multiple coiled springs are two in number.

4. The apparatus of claim 1, said container further comprising multiple means for holding golf tees.

5. The apparatus of claim 4, said means for holding golf tees being mounted on the exterior surface of said container.

6. The apparatus of claim 5, said means for holding golf tees further comprising U-shaped members located in the generally horizontal plane having an aperture therein said aperture having a generally vertical axis wherein said golf tee can be placed.

7. The apparatus of claim 6, wherein said multiple means for holding golf tees are four in number.

8. The apparatus of claim 1, said container further comprising a magnetic top for holding a metallic ball marker.

9. The apparatus of claim 1, said multiple vertical members being spaced apart a distance slightly less than the diameter of the golf ball whereby said golf ball is securely held.

10. The apparatus of claim 1, said multiple coil springs being in the generally horizontal plane wherein said springs put pressure on the golf balls.

* * * * *